US006302319B1

(12) United States Patent
Peeples et al.

(10) Patent No.: US 6,302,319 B1
(45) Date of Patent: Oct. 16, 2001

(54) PARTY TRAY CARRIER

(75) Inventors: Kathleen Gay Peeples, Houston, TX (US); Joseph F. Fiore, Lebanon, PA (US); Paula Roushani, Cypress, TX (US)

(73) Assignee: Igloo Products Corp., Houston, TX (US)

( * ) Notice: Subject to any disclaimer, the term of this patent is extended or adjusted under 35 U.S.C. 154(b) by 0 days.

(21) Appl. No.: 09/818,053

(22) Filed: Mar. 27, 2001

(51) Int. Cl.[7] ..... B65D 5/46; B65D 5/42

(52) U.S. Cl. ..... 229/103.11; 229/117.23; 229/122; 229/125.37

(58) Field of Search ..... 229/103.11, 117.23, 229/122, 125.37, 902, 906

(56) References Cited

U.S. PATENT DOCUMENTS 2,059,621 * 11/1936 Belcher ..... 229/117.23
2,663,485 * 12/1953 Johnson ..... 229/122
2,721,022 * 10/1955 Billerbeck ..... 229/125.37
3,153,504 * 10/1964 Mischel et al. ..... 229/122
3,307,770 * 3/1967 Wysocki ..... 229/122
3,360,112 * 12/1967 Johnson ..... 229/117.23
5,180,075 * 1/1993 Montalbano ..... 229/122
5,445,286 * 8/1995 Guimarin ..... 229/902
5,454,471 * 10/1995 Norvell ..... 229/125.37
5,813,597 * 9/1998 Wakevainen ..... 229/122
6,223,400 * 5/2001 Lenack ..... 229/125.37

* cited by examiner

*Primary Examiner*—Gary E. Elkins
(74) *Attorney, Agent, or Firm*—Duane, Morris & Heckscher LLP

(57) ABSTRACT

The present invention is directed toward an insulated party tray carrier. The party tray carriers of the present invention comprise a top wall, a bottom wall, a back wall, a front wall and side walls. The walls of the present invention are insulated to reduce the rate of heat transfer from items inside the carrier to the ambient environment. The present invention also comprises one or more ribs to add structural integrity to the party tray carrier.

20 Claims, 1 Drawing Sheet

PARTY TRAY CARRIER

BACKGROUND OF THE INVENTION

1. Field of the Invention

The present invention is directed toward an insulated party tray carrier. The party tray carriers of the present invention comprise a top wall, a bottom wall, a back wall, a front wall and side walls. The walls of the present invention are insulated to reduce the rate of heat transfer from items inside the carrier to the ambient environment. The present invention also comprises one or more ribs to add structural integrity to the party tray carrier.

2. Description of the Prior Art

Prior art party tray carriers lack internal volume.

Prior art party tray carriers have limited insulating capacity which limits the duration that warm or refrigerated food items can be carried in such prior art bags without reaching a thermal equilibrium with ambient temperature conditions. In the party tray delivery art, it is desirable to deliver cooked food items that are at a temperature similar to the temperature of the items when they are removed from an oven. It is also desirable to deliver refrigerated food items at a temperature similar to the temperature of the items when they are removed from a refrigerator.

Prior art party tray carriers also lack the structural rigidity needed to carry heavy trays. The present invention employs one or more ribbed walls to add structural rigidity.

SUMMARY OF THE INVENTION

The present invention is directed toward a thermally insulated party tray carrier comprising an insulated back wall comprising a top outer edge, a bottom outer edge, a first side outer edge, and a second side outer edge. The party tray carrier further comprises an insulated top wall comprising a back edge attached to the top outer edge of the back wall such that the top wall is substantially perpendicular to the back wall and further comprising a front edge opposite the back edge. The top wall further comprises two horizontally extending rib channel. The invention further comprises a handle attached to the top wall and an adhesive strip is mounted on the top wall within 25 inches of the front edge.

The party tray carrier further comprises an insulated bottom wall comprising a back edge attached to the bottom outer edge of the back wall such that the bottom wall is substantially perpendicular to the back wall and further comprising a front edge opposite the bottom wall back edge.

The invention further comprises a first insulated side wall attached to the back wall, bottom wall and top wall such that the first side wall, is substantially perpendicular to the back wall, the bottom wall, and the top wall, when the first side wall is in an unfolded position. The second side wall further comprises a front section.

The invention also comprises a second insulated side wall attached to the back wall, bottom wall, and top wall, such that the second side wall is substantially perpendicular to the back wall, the bottom wall, and the top wall, when the second side wall is in an unfolded position. The second side wall is attached to the top wall and bottom walls opposite from the first side wall. The second side wall further comprises a front section.

The invention further comprises a rib placed in each rib channel.

The invention further comprises an insulated front wall comprising a bottom border, a top border, and two side borders. The bottom border is pivotably attached to the front edge of the bottom wall.

The invention further comprises a closure flap attached to the top border of the front wall, and sized sufficiently large to extend over the adhesive strip. The invention also comprises an adhesive affixed to the closure flap such that when the closure flap is placed on the adhesive strip, the adhesive material adheres to the adhesive strip.

DESCRIPTION OF THE PREFERRED EMBODIMENTS

Figure 1:
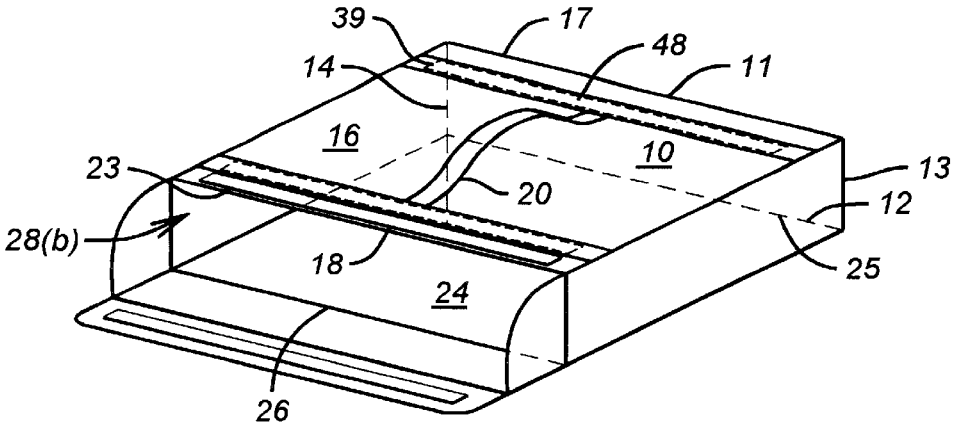
FIG. 1 is an isometric view of the present invention in an unfolded position.

The present invention is directed toward a thermally insulated party tray carrier comprising an insulated back wall 10 comprising a top outer edge 11, a bottom outer edge 12, a first side outer edge 13, and a second side outer edge 14 as shown in FIG. 1. The pizza bag further comprises an insulated top wall 16 comprising a back edge 17 attached to the top outer edge of the back wall such that the top wall is substantially perpendicular to the back wall and further comprising a front edge 18 opposite the back edge as shown in FIG. 1.

In a preferred embodiment the top wall comprises a horizontally extending rib channel 48 as shown in FIG. 1. In another preferred embodiment, the top wall and the bottom wall are rectangular. In another preferred embodiment, the top wall comprises two substantially parallel rib channels.

Figure 3:
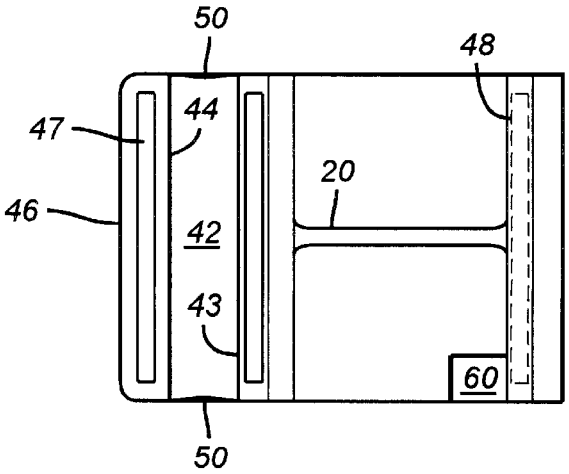
FIG. 3 is a top view of an embodiment of the front wall.

In a preferred embodiment, the top wall further comprises a label holder 60 mounted on the top wall, and capable of holding labels or documents, such as invoices, or customer order forms, as shown in FIG. 3. In a preferred embodiment, the label holder comprises a transparent surface, thereby permitting a person holding the tray carrier to read a document inserted in the label holder. The invention further comprises a handle 20 attached to the top wall and an adhesive strip 23 mounted on the top wall within 25 inches of the front edge as shown in FIGS. 1 and 3. In a preferred embodiment, the handle is made from a nonrigid or flexible material, such as webbing. In a preferred embodiment, the handle is placed substantially perpendicular to the rib channel of said top wall, as shown in FIG. 3.

The invention further comprises an insulated bottom wall 24 comprising a back edge attached to the bottom outer edge of the back wall such that the bottom wall is substantially perpendicular to the back wall and further comprising a front edge 26 opposite the bottom wall back edge. In a preferred embodiment, the top wall comprises two substantially parallel rib channels as shown in FIG. 1.

Figure 2:
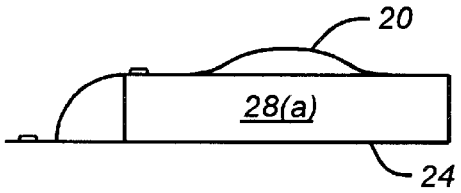
FIG. 2 is a side view of an embodiment of the second side wall.

The invention further comprises a first insulated side wall 28(*a*) attached to the back wall, bottom wall and top wall such that the first side wall, is substantially perpendicular to the back wall, the bottom wall, and the top wall, when the first side wall is in an unfolded position as shown in FIGS. 1 and 2. The first side wall further comprises a front section.

The invention further comprises a second insulated side wall 28(*b*) attached to the back wall, bottom wall, and top wall, such that the second side wall is substantially perpendicular to the back wall, the bottom wall, and the top wall, when the second side wall is in an unfolded position as shown in FIG. 1. The second side wall is attached to the top wall and bottom walls opposite from the first side wall as shown in FIG. 1. The second side wall further comprises a front section.

In a preferred embodiment, the first side wall and second side wall are rectangular. In another preferred embodiment, the height of the side walls in an unfolded position is at least 2.0 inches. In another preferred embodiment, the first side wall and second side wall are double layered.

The invention further comprises a rib 39 placed in each rib channel as shown in FIG. 1. In a preferred embodiment, the ribs are flexible. In another preferred embodiment, the ribs are inflexible. In another preferred embodiment the length of each rib is at least 75% of the length of the rib channel in which the rib is installed.

The invention further comprises an insulated front wall 42 comprising a bottom border 43, a top border, 44, and two side borders 50 as shown in FIGS. 1 and 3. The bottom border is pivotably attached to the front edge of the bottom wall.

The invention further comprises a closure flap 46 attached to the top border of the front wall, and sized sufficiently large to extend over the adhesive strip. The invention also comprises an adhesive 47 affixed to the closure flap such that when the closure flap is placed on the adhesive strip, the adhesive material adheres to the adhesive strip as shown in FIGS. 1 and 3. In a preferred embodiment, the adhesive strip and the adhesive material comprise hook and loop fastening members. A suitable material comprising hook and loop fastening members is sold under the trademark VELCRO®.

In a preferred embodiment, the side walls, top wall, bottom wall, and front wall define an internal volume of at least 4.0 cubic inches when the side walls are in an unfolded position. In another preferred embodiment, the internal volume of the party tray carrier is at least 18.0 cubic inches when the side walls are in an unfolded position. In another preferred embodiment, the bag weighs less than 4.0 pounds.

The foregoing disclosure and description of the invention are illustrative and explanatory. Various changes in the size, shape, and materials, as well as in the details of the illustrative construction may be made without departing from the spirit of the invention.

What is claimed is:

1. A thermally insulated party tray carrier comprising:

a. an insulated back wall comprising a top outer edge, a bottom outer edge, a first side outer edge, and a second side outer edge;

b. an insulated top wall comprising a back edge attached to said top outer edge of said back wall such that said top wall is substantially perpendicular to said back wall and further comprising a front edge opposite said back edge, said top wall further comprising two horizontally extending rib channels;

c. a handle attached to said top wall;

d. an adhesive strip mounted on said top wall within 25 inches of said front edge;

e. an insulated bottom wall comprising a back edge attached to said bottom outer edge of said back wall such that said bottom wall is substantially perpendicular to said back wall and further comprising a front edge opposite said bottom wall back edge;

f. a first insulated side wall attached to said back wall, bottom wall and top wall, such that said first side wall is substantially perpendicular to said back wall, said bottom wall, and said top wall, said first side wall further comprising a front section;

g. a second insulated side wall attached to said back wall, bottom wall and top wall, such that said second side wall is substantially perpendicular to said back wall, said bottom wall, and said top wall, said second side wall further comprising a front section;

h. a rib placed in each rib channel;

i. an insulated front wall comprising a bottom border and a top border and two side borders, said bottom border being pivotably attached to the front edge of said bottom wall;

j. a closure flap attached to the top border of said front wall and sized sufficiently large to extend over said adhesive strip; and k. an adhesive material affixed to said closure flap such that when said closure flap is placed on said adhesive strip, said adhesive material adheres to said adhesive strip.

2. The carrier of claim 1, wherein said top wall and said bottom wall are rectangular.

3. The carrier of claim 1, wherein said first side wall and said second side wall are rectangular.

4. The carrier of claim 1, wherein said adhesive strip and said adhesive material comprised of hook and loop.

5. The carrier of claim 1, wherein the height of said side walls is at 2.0 inches.

6. The carrier of claim 5, wherein said side walls, top wall, bottom wall, and front wall define an internal volume of at least 18.0 cubic inches.

7. The carrier of claim 1, wherein said top wall comprises two substantially parallel rib channels.

8. The carrier of claim 1, wherein each of said side walls are doubled layered.

9. The carrier of claim 8, wherein said bag weighs less than 4.0 pounds.

10. The carrier of claim 5, wherein said side walls, top wall, bottom wall, and front wall define an internal volume of at least 18.0 cubic inches.

11. A thermally insulated party tray carrier comprising:

a. an insulated back wall comprising a top outer edge, a bottom outer edge, a first side outer edge, and a second side outer edge;

b. an insulated top wall comprising a back edge attached to said top outer edge of said back wall such that said top wall is substantially perpendicular to said back wall and further comprising a front edge opposite said back edge, said top wall further comprising a horizontally extending rib channel;

c. a flexible handle attached to said top wall;

d. an adhesive strip mounted on said top wall within 25 inches of said front edge;

e. an insulated bottom wall comprising a back edge attached to said bottom outer edge of said back wall such that said bottom wall is substantially perpendicular to said back wall and further comprising a front edge opposite said bottom wall back edge;

f. a first insulated side wall attached to said back wall, bottom wall and top wall, such that said first side wall is substantially perpendicular to said back wall, said bottom wall, and said top wall, said first side wall further comprising a front section;

g. a second insulated side wall attached to said back wall, bottom wall and top wall, such that said second side wall is substantially perpendicular to said back wall, said bottom wall, and said top wall, said second side wall further comprising a front section;

h. a rib placed in each rib channel;

i. an insulated front wall comprising a bottom border and a top border and two side borders, said bottom border being pivotably attached to the front edge of said bottom wall;

j. a closure flap attached to the top border of said front wall and sized sufficiently large to extend over said adhesive strip; and k. an adhesive material affixed to said closure flap such that when said closure flap is placed on said adhesive strip, said adhesive material adheres to said adhesive strip.

12. The carrier of claim 11, wherein said top wall comprises two substantially parallel rib channels.

13. The carrier of claim 11, wherein said adhesive strip and said adhesive material comprised of hook and loop.

14. The carrier of claim 12, wherein the height of said side walls is at 2.0 inches.

15. The carrier of claim 11, wherein said handle is placed substantially perpendicular to the rib channel of said top wall.

16. The carrier of claim 11, wherein the length of each rib is at least 75% of the length of the rib channel in which it is installed.

17. The carrier of claim 11, further comprising a label holder mounted on said top wall.

18. The carrier of claim 17, wherein said label carrier comprises a transparent surface.

19. A thermally insulated party tray carrier comprising:

a. an insulated back wall comprising a top outer edge, a bottom outer edge, a first side outer edge, and a second side outer edge;

b. an insulated top wall comprising a back edge attached to said top outer edge of said back wall such that said top wall is substantially perpendicular to said back wall and further comprising a front edge opposite said back edge, said top wall further comprising a horizontally extending rib channel;

c. a handle attached to said top wall and positioned substantially perpendicular to the rib channel of said top wall;

d. an adhesive strip mounted on said top wall within 25 inches of said front edge;

e. an insulated bottom wall comprising a back edge attached to said bottom outer edge of said back wall such that said bottom wall is substantially perpendicular to said back wall and further comprising a front edge opposite said bottom wall back edge;

f. a first insulated side wall attached to said back wall, bottom wall and top wall, such that said first side wall is substantially perpendicular to said back wall, said bottom wall, and said top wall, said first side wall further comprising a front section;

g. a second insulated side wall attached to said back wall, bottom wall and top wall, such that said second side wall is substantially perpendicular to said back wall, said bottom wall, and said top wall, said second side wall further comprising a front section;

h. a rib placed in each rib channel, wherein the length of said rib is at least 75% of the length of said rib channel;

i. an insulated front wall comprising a bottom border and a top border and two side borders, said bottom border being pivotably attached to the front edge of said bottom wall;

j. a closure flap attached to the top border of said front wall and sized sufficiently large to extend over said adhesive strip; and k. an adhesive material affixed to said closure flap such that when said closure flap is placed on said adhesive strip, said adhesive material adheres to said adhesive strip.

20. The carrier of claim 19, wherein said top wall comprises two substantially parallel rib channels.

* * * * *